US006673280B1

(12) United States Patent
Yang et al.

(10) Patent No.: US 6,673,280 B1
(45) Date of Patent: Jan. 6, 2004

(54) PROCESS FOR MAKING A BOARD PRODUCT FROM SCRAP MATERIALS

(75) Inventors: Alain Yang, Bryn Mawr, PA (US); Gary Tripp, Corbin, KY (US); Mark Trabbold, Harleysville, PA (US)

(73) Assignee: CertainTeed Corporation, Valley Forge, PA (US)

( * ) Notice: Subject to any disclaimer, the term of this patent is extended or adjusted under 35 U.S.C. 154(b) by 62 days.

(21) Appl. No.: 10/176,288

(22) Filed: Jun. 20, 2002

(51) Int. Cl.[7] ..... B29B 11/02; B29B 11/14

(52) U.S. Cl. ..... 264/36.18; 264/36.22; 264/109; 264/115; 264/122; 264/125

(58) Field of Search ..... 264/36.18, 36.22, 264/109, 115, 122, 125

(56) References Cited

U.S. PATENT DOCUMENTS

| | | | | | |
|---|---|---|---|---|---|
| 3,671,615 | A | | 6/1972 | Price | |
| 5,264,257 | A | * | 11/1993 | Martinez et al. | 428/2 |
| 5,439,735 | A | | 8/1995 | Jamison | |
| 5,685,938 | A | | 11/1997 | Knapp et al. | |
| 6,099,775 | A | * | 8/2000 | Bargo et al. | 264/122 |
| 6,217,946 | B1 | | 4/2001 | Bolind et al. | |

* cited by examiner

*Primary Examiner*—Stephen J. Lechert, Jr.
(74) *Attorney, Agent, or Firm*—Duane Morris LLP

(57) ABSTRACT

The present invention relates to a method of making a board product with fiber scrap materials, including the steps of adding a binder powder to the fiber scrap materials, processing the scrap fiber into pieces and mixing the fiber scrap materials with the binder powder, distributing the fiber and binder combination across the width of a forming conveyor, and melting the combination to fix the fiber with the binder.

19 Claims, No Drawings

PROCESS FOR MAKING A BOARD PRODUCT FROM SCRAP MATERIALS

FIELD OF THE INVENTION

The present invention relates to a product and a method of making a board product from scrap materials.

BACKGROUND OF THE INVENTION

Insulation is usually discussed in terms of R-values: higher R-values represent better insulation and greater resistance to heat flow. Typically, higher R-values are recommended for ceilings than for walls and floors. Although local building codes should specify R-values for homes, these building codes often represent a minimum level of insulation necessary for comfort, rather than a level recommended for optimal energy efficiency.

Insulation is available in a variety of forms, including batts and blankets, rigid board, and loose fill. Each type is made to fit in a different part of a structure. Batts, usually composed of fiberglass or rock wool, are made to fit between the studs in walls or between the joists of ceilings or floors. Rolls or blankets are also usually made of fiberglass, and can be laid over the floor in the attic. Loose-fill insulation, usually composed of fiberglass, rock wool or cellulose, can either be poured or blown into spaces. Rigid foam boards are made of e.g. polyisocyanurate, extruded polystyrene, expanded polystyrene or other materials. These boards are lightweight, provide structural support, and generally have an R-value of 4 to 7 per inch. This fiberboard product is the focus of the present invention.

When adding insulation to a home or other structure, a builder will likely use batts or blankets on attic floors, in order to insulate first-story floors from crawl spaces or unheated basements, or to insulate exterior walls. Rigid boards may be added to basement walls, exposed foundations, cathedral ceilings, and exterior walls. Both types of insulation (batts and rigid boards) may be used in order to insulate the access openings to attic spaces.

Loose-fill insulation may be blown or poured into existing walls or attics. Loose-fill insulation typically requires less energy to produce than other forms of insulation; cellulose loose-fill insulation is made from recycled materials.

The present invention relates to a method of making a board product from building insulation scrap materials.

Note that commercial board insulation is designed for commercial and industrial applications, such as curtain walls, where higher R-values per inch, and ease of handling are desired. It is composed of glass fibers bonded together with a thermosetting binder. Scraps of such materials are the focus of the present invention.

DETAILED DESCRIPTION OF THE INVENTION

The insulation assemblies prepared by the process of the present invention may be manufactured using conventional mineral fiber blankets or mats, for example, glass fiber mats produced from fibers formed from a glass melt, and treated with a binder such as phenol-formaldehyde resin-based binder.

In the process of the present invention, rotary glass fiber insulation scraps (batts or rolls), and dry powder binder are processed through a mat forming device, and into small nodules, and are then processed into an air lay forming hood.

The small pieces of insulation scrap and binder are well blended, and form a fiber-binder primary mat in the air lay process. The dry binder is then melted and cured, as the material passes through a curing oven, which holds the fiber nodules together, giving a finished fiberboard.

Varying percentages of textile fibers (from about 5 to 50 weight percent, preferably from about 10 to 30 weight percent, most preferably from about 15 to 20 weight percent) may be added with rotary fiber insulation scraps, in order to reinforce the flexibility and parting strength of the boards.

In a preferred embodiment of the present invention (I), a rotary glass fiber in scrap or mat (less than about 15 microns in average diameter, about 3–10 microns in average diameter most preferred), is fed to a mat former, whereby the scrap insulation is processed into small pieces (less than 1 square inch, no more than about 0.2 inch thick) and combined with binder (resin) powder.

A glass scrim or non-woven mat is then placed at the bottom and/or the top of the fiber mat in the forming hood. The resulting material is subjected to a sucking/forming section, in order to distribute the fiber evenly across the width of a forming conveyor. This is followed by a curing step in an oven at about 400–600° F., in order to fix the fiber board structure with the cured binder. A finished, uncoated board is the result, produced from wholly recycled material (except for non-woven mat and binder).

In an alternative embodiment of the present invention (II), a bale of rotary glass fiber insulation scrap preprocessed into small pieces from insulation scrap, and with additional binder is fed to blowing equipment, opening the fiber and binder blend into small nodules; the glass scrim/non-woven mat placing step and subsequent steps proceed as noted in (I) above.

In a further alternative embodiment, reinforcement with textile fiber may be achieved: Textile or other fibers (thermoplastic fibers; polypropylene, nylon, etc.) are subjected to a "fiber opening process", then combined with a rotary glass fiber scrap or mat as in (I) above. In addition, the process described above (II) may be integrated into this embodiment, in order to achieve a more compact fiber.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of making a board product with rotary fiber insulation, comprising the steps of:

(a) adding a binder powder to the rotary fiber insulation;

(b) processing the rotary fiber insulation into pieces, and mixing the rotary fiber insulation with the binder powder;

(c) distributing the fiber and binder combination across the width of a forming conveyor; and (d) melting the combination to fix the fiber with the binder.

2. The method as recited in claim 1, wherein said rotary fiber insulation includes fibers of scrap materials.

3. The method as recited in claim 2, wherein the fibers of scrap materials are less than about 15 microns in average diameter.

4. The method as recited in claim 1, wherein the combination is added to a curing oven.

5. The method as recited in claim 4, wherein the temperature of the curing oven is from about 400–600° F.

6. The method as recited in claim 2, wherein from about 5 to 50 weight percent of textile fibers are added to the fibers of scrap materials.

7. The method as recited in claim 6, wherein from about 10 to 30 weight percent of textile fibers are added to the fibers of scrap materials.

8. The method as recited in claim 7, wherein from about 15 to 20 weight percent of textile fibers are added to the fibers of scrap materials.

9. The method as recited in claim 1, wherein blowing equipment forms nodules of fiber and binder.

10. The method as recited in claim 3, wherein the pieces of fibers of scrap materials are about 3–10 microns in diameter.

11. A method of making a board product with fibers of scrap materials, comprising the steps of:

(a) processing a bale of fibers of scrap materials and additional dry binder, thereby opening the materials into nodules;

(b) distributing the fibers and additional dry binder combination across the width of a forming conveyor; and (c) melting and curing the combination to fix the fibers with the binder.

12. The method as recited in claim 11, wherein the fibers of scrap materials are less than about 15 microns in average diameter.

13. The method as recited in claim 11, wherein the combination is added to a curing oven.

14. The method as recited in claim 13, wherein the temperature of the curing oven is from about 400–600° F.

15. The method as recited in claim 11, wherein from about 5 to 50 weight percent of textile fibers are added to the fiber scrap materials.

16. The method as recited in claim 15, wherein from about 10 to 30 weight percent of textile fibers are added to the fibers of scrap materials.

17. The method as recited in claim 16, wherein from about 15 to 20 weight percent of textile fibers are added to the fibers of scrap materials.

18. The method as recited in claim 11, wherein blowing equipment forms nodules of fiber and binder.

19. The method as recited in claim 12, wherein the fibers of scrap materials are about 3–10 microns in average diameter.

* * * * *